United States Patent [19]

Smith, Jr.

[11] 4,407,107

[45] Oct. 4, 1983

[54] HORIZONTAL BALING APPARATUS AND METHOD

[75] Inventor: George F. Smith, Jr., Spartanburg, S.C.

[73] Assignee: Hergeth, Incorporated, Spartanburg, S.C.

[21] Appl. No.: 258,871

[22] Filed: Apr. 29, 1981

Related U.S. Application Data

[63] Continuation-in-part of Ser. No. 186,193, Sep. 11, 1980, Pat. No. 4,360,997.

[51] Int. Cl.[3] ..... B65B 11/58; B65B 63/02

[52] U.S. Cl. ..... 53/528; 53/176; 53/592

[58] Field of Search ..... 53/399, 436, 461, 528, 53/592, 176; 100/255

[56] References Cited

U.S. PATENT DOCUMENTS

| | | | |
|---|---|---|---|
| 346,470 | 8/1886 | Elliot | 100/255 |
| 675,258 | 5/1901 | Whitman | 53/528 |
| 1,221,767 | 4/1917 | Rowley | 53/528 |
| 1,352,345 | 9/1920 | Becker | 53/528 |
| 1,452,988 | 4/1923 | Straubel | 53/528 |
| 1,913,727 | 6/1933 | Shaffer | 53/528 |
| 1,985,438 | 12/1934 | Bethel | 100/255 |
| 2,917,881 | 12/1959 | Zachow | 53/528 |
| 3,816,970 | 6/1974 | Van Doorn | 53/528 |
| 3,962,846 | 6/1976 | Nietzel | 53/528 |

*Primary Examiner*—John Sipos

*Attorney, Agent, or Firm*—Wellington M. Manning, Jr.; Luke J. Wilburn, Jr.

[57] ABSTRACT

A horizontal baling apparatus including a horizontally reciprocally movable compression ram for compressing material into a totally enclosed baling chamber which is defined by an end platen, a compression platen on the ram, a bottom wall, and movable side and top walls. The end platens and bottom wall are adapted to receive bagging material thereover, which is held secure during formation of the bale, after which the baling chamber may be opened by opening the side and top walls, and the bagging material wrapped substantially totally around the six bale sides while the bale is held under compression, and after which appropriate strapping may be applied around the wrapped bale, likewise while the bale is under compression.

11 Claims, 7 Drawing Figures

HORIZONTAL BALING APPARATUS AND METHOD

CROSS REFERENCE TO RELATED APPLICATION

This application is a continuation-in-part of my copending application Ser. No. 186,193, filed Sept. 11, 1980 U.S. Pat. No. 4,360,967.

BACKGROUND OF THE INVENTION

This invention relates to a horizontal baling apparatus for the compression of fibrous or other loose materials into coherent bale form in a totally enclosed environment, after which the formed bale may be wrapped with suitable bagging material and strapped to afford an appropriate package of material for storage and/or further processing.

In general, balers or compacters in which hydraulically operated reciprocal rams are utilized for the compression of loose materials into compact bale or package form have been used extensively for many years. Principally such baling apparatus has operated on a vertical basis where a vertically oriented reciprocally operated ram is provided for either an upstroke baling operation or a downstroke baling operation where during the baling operation, a face plate on the ram engages and compresses material to be baled into the confines of a baling chamber. The baling chamber, depending upon the particular overall operation of the apparatus has taken numerous forms. In vertically oriented bale presses, wrapping of the bale subsequent to formation of same has not presented a particular problem. With the vertically oriented presses, however, due to the height of same, it has oftentimes been necessary to rearrange equipment within the facility or even make structural modifications to the facility such as construction of a penthouse or other structure above the normal roof line of the building to accept the necessary height for reciprocal movement of the ram. With the upstroke vertical packer, while it was not generally necessary to construct a penthouse, a pit at a subterranean level with respect to the floor has been required to receive the ram and its associated motive arrangement. Both of the above vertically oriented systems thus require considerable capital expenditure by way of initial installation, and obviously once installed, the press is immobile, thus limiting the ability of one to reorganize the facility.

In attempting to overcome some of the economic and operational disadvantages of the vertically oriented presses, presses have been utilized where the plane of reciprocal movement of the ram is horizontal, with the material to be compressed being deposited ahead of the face of the ram to be forced during ram movement into a chamber or area where the material is compressed into bale form. While the horizontal press, per se, overcomes the general need for structural modification to an existing building to accommodate the utilization of same, certain disadvantages have heretofore been experienced with the horizontal presses. Particularly, the ability to properly wrap bagging materials around the bale after formation of same and without loss of bale integrity has been difficult where wrapping is required. For materials that once compressed into bale form, retain the integrity of the bale, such as scrap metals, wrapping is generally not required, and the bale may need only be strapped which may be easily accomplished in the baling chamber by the use of opposed end sheets or blanks around which suitable ties or strapping material are secured.

In certain industries, such as the textile and paper industries, a significant amount of waste fibrous or other material is produced which requires proper disposal or packaging for subsequent sale or reclamation. Oftentimes these fibrous or other materials encountered are of such character and size that once formed into a bale, bale integrity will not be maintained absent suitable wrapping material totally around the bale prior to strapping. A proper handling of these materials thus requires compression of the fibrous materials into bale form, followed by enclosure of the bale with a suitable cover and strapping or tieing while retaining at least a certain degree of pressure on the bale during the entire operation. Otherwise, the compacted fibrous materials, as mentioned above, will expand and distort or otherwise destroy the previously formed bale.

In the textile industry particularly, manmade fibers that have been thermally or otherwise processed to achieve certain stretch or bulk characteristics, retain a particular configurational memory. Fibrous waste materials of this type of yarn once formed into a bale possesses tremendous force due to the aforementioned memory characteristics such that unless properly wrapped and strapped, the bale will virtually explode. Still further, particularly in shearing operations, fibrous waste is produced having virtually no cohesive force or mechanical fiber to fiber interlocking ability to assist in retention of formed bale integrity. This particular type of material once compressed, will simply fall from the compressed state upon removal of pressure if the bale is not wrapped. Significantly, these types of materials heretofore have not been baled, but have simply been stored in loose, uncompressed form in corrugated containers or the like, which of course requires significant storage space and handling requirements.

While horizontal balers have heretofore been provided for baling paper products, fibrous materials and the like, wrapping of the bale has generally required extrinsic apparatus to remove the bale from the compression chamber. Such an arrangement is illustrated in U.S. Pat. Nos. 3,613,556 and 3,762,309 to Wright et al where the formed bale is forced from the compression chamber for the external application of strapping thereto.

Generally speaking insofar as horizontal balers are concerned, devices have also been provided with "closed baling chambers" where compressible materials such as corrugated paper board, aluminum cans, or the like are compressed and tied, but not wrapped or bagged. The concept of wrapping or bagging the compressed bale within the baling chamber represents a significant departure from the prior art balers where the bale was simply tied with wire, metal strapping or the like. In my presently copending application, Ser. No. 156,193, filed Sept. 11, 1980, and entitled "Baling Apparatus and Method", a horizontal baler and baling method is disclosed wherein once a bale of compressed material is produced, and while compression pressure is maintained thereon by the position of the ram, side doors are opened, the bale is wrapped at least in part, strapping is applied therearound, compression is released and the bale is then removed from the baling chamber for completion of wrapping. The present invention is likewise directed to the same general concept of that set forth in my copending application referred to above, including certain improvements thereon as specified hereinafter.

There is no known prior art that is believed to anticipate or suggest the subject matter of the present invention.

SUMMARY OF THE INVENTION

It is an object of the present invention to provide an improved horizontal baling and bagging apparatus.

It is an object of the present invention to provide an improved horizontal baler capable of permitting substantially total enclosure and strapping of a compressed bale while in the baling chamber.

Another object of the present invention is to provide a horizontal baling and bagging apparatus in which means are provided for receiving and holding bagging material during bale formation for substantially complete enclosure of the bale.

Still another object of the present invention is to provide a horizontal baling and bagging apparatus for substantially totally wrapping a formed bale while ram pressure is held thereon.

Yet another object of the present invention is to provide an improved method of substantially totally wrapping and strapping a formed bale of compressible material while the bale remains in the baling chamber in which it was formed.

Generally speaking, the horizontal baling and bagging apparatus of the present invention comprises a horizontal bale compression means, a baling chamber and a compression ram mounted for reciprocal movement with respect thereto, said baling chamber being defined by two end walls, a bottom wall, a top wall, and two side walls, said top and side walls being moveable between a closed baling position and an open bagging position; means to receive bagging material on at least certain of said walls defining said baling chamber during manufacture of a bale of compressed material adequate to substantially cover said bale in said baling chamber without removing same therefrom; and means for applying strapping around said bagging material after same has been wrapped about said bale, whereby a substantially completely wrapped bale of material may be removed from said apparatus.

More specifically, in a preferred arrangement according to the present invention, means are provided adjacent an outer end wall of the baling chamber to hold peripheral edges of a bagging material that is received thereover. Particularly, a clamp means is provided at the top of the wall and spring biased hook means behind the platen. Likewise, the platen on the face of the ram is provided with means around the periphery of same to receive peripheral edges of a bagging material received across the face of the ram platen. Bagging material chambers with hinged door access are provided along the bottom of the platen and along the height of each side of the ram behind the platen. A further bagging material chamber is located across the top of the ram platen, behind a fixed wall defining a continually open access slot adjacent the top of the platen. The bottom wall of the baling chamber is provided with a lip beneath which an edge of bagging material may be received with opposed ends of same secured outside the baling chamber whereby the material is held taut.

After the bale of compressed material has been formed, and the side and top walls moved away, the bale is exposed in the compressed state. Edges of the bagging material may then be released or removed from the respective areas and pulled over the bale, substantially totally enclosing same except as stated hereinafter. End platens defined a plurality of horizontally extending, spaced apart grooves through which strapping material may be passed to surround the covered bale and secured therearound. Since the bale is in the fully compressed state, the strapping is loosely secured about the bale and certain terminal bagging edges are folded thereunder. Upon release of compression, the bale will expand thus tightening the strapping to provide the completely wrapped bale which can then be removed from the baling chamber.

There is generally a tendency with prior art presses to produce a bale having bulbuous corners due to excess expansion during wrapping and/or strapping. With the above wrapping arrangement such can be avoided, especially when the ram platen is provided with protruding horizontal sections adjacent the bottom and top edges of same.

The method of baling and bagging compressible material according to the present invention generally comprises the steps of providing a bagging material completely along a bottom wall and opposite end walls of a closed baling chamber while securing peripheral edges of same outside said baling chamber; forcing compressible material into said baling chamber and compressing same into a bale; opening side and top walls of said baling chamber while retaining ram compression on said bale; removing said peripheral edges of said secured bagging material and wrapping same about the side and top surfaces of said bale in said baling chamber; passing strapping materials around said bale, and along the height of same, outside said bagging materials and loosely securing opposite ends of said strapping materials; folding peripheral edges of bagging material under certain of said loosely secured strapping materials, and releasing compression on said bale whereby said bale expands to produce a tightly wrapped and secured product.

As a further embodiment of the present invention, a roll of wrapping material may be provided outside the baling chamber, which, before the baling operation starts may be secured across the bottom wall of the baling chamber, extending rearwardly therefrom, along the face of the end wall platen. After bale formation and the top and side walls are opened, the roll of bagging material may then be brought totally across the top of the bale, thus providing a continuous wrap about substantially five of the six sides of the bale. The sixth side is covered by bagging material received on the ram platen which can then be overlapped with the continuous bagging to totally enclose the bale. Strapping would be accomplished as discussed above.

DESCRIPTION OF THE PREFERRED EMBODIMENTS

Figure 1:
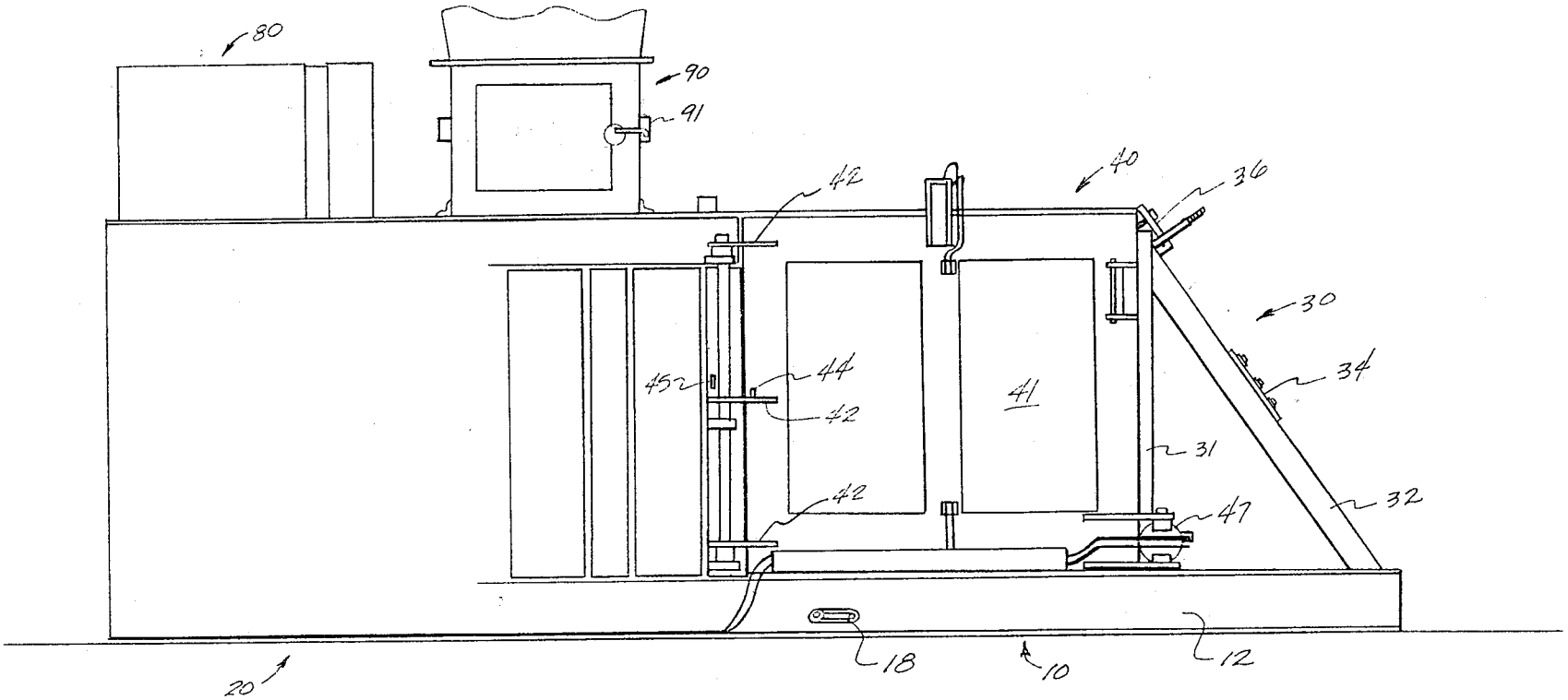
FIG. 1 is a side elevational view of a horizontal baling and bagging press according to teachings of the present invention.

Making reference to the Figures, preferred embodiments of the present invention will now be described in detail. In FIG. 1, there is illustrated a frame work generally indicated as 10 having a housing generally indicated as 20 secured thereto and defining a horizontal passageway 21 therewithin, the purpose of which will be described hereinafter. At an end of frame 10 opposite housing 20 is a vertically oriented platen generally indicated as 30, which in a most preferred embodiment, is stationary. Side door sections generally indicated as 40 and 50 are hingedly secured between housing 20 and vertical platen 30 and cooperate with other elements to be defined hereinafter to define a fibrous material baling and bagging chamber therebehind. A feed means generally indicated as 90 is provided atop frame 10 to feed fibrous material into passageway 21 in the front of a ram generally indicated as 60 received within passageway 21 for reciprocal movement between a first, material feed position and a second, material compression position. A motive power system generally indicated as 80 is provided for imparting movement to the ram. Power system 80 is preferably a hydraulic or other fluid powered system which will be described in more detail hereinafter.

Generally speaking, the apparatus may operate in an automatic or manual mode. In automatic, with bagging materials appropriately placed in the baling chamber and the side doors 40 and 50 closed, material to be compressed is fed into the feed means 90 and then into passageway 21 in front of ram 60 until a predetermined quantity of material is sensed within feed means 90 and thus in passageway 21 in front of ram 60. Upon sensing the proper quantity of material, the hydraulic system 90 is actuated to move ram 60 forward and compress the material then within passageway 21 into the baling chamber, after which the ram is automatically retracted, thus completing one compression cycle. The cycles continue until a bale of a predetermined size is produced.

Making particular reference to FIGS. 1, 2 and 3, specifics of the baling and bagging apparatus of the present invention will be described in more detail. Frame 10 of the apparatus may take any suitable form, but preferably comprises a pair of oppositely located horizontal base elements 12 and 14 between which is provided a bottom wall 16, the surface of which between housing 20 and platen 30 defines a bottom wall of the baling chamber. The bottom wall extends rearwardly within the housing 20 and defines a lower surface on which the ram generally indicated as 60 (see FIG. 3) is supported for horizontal movement. Frame 10 likewise includes various vertical support members and additional top horizontal support members not specifically alluded to which wall members are secured to provide housing 20 with the horizontal passageway 21 being defined therewithin. The reciprocally movable ram 60 used in conjunction with the present apparatus is received within the passageway defined by housing 20 and itself takes the form of a generally rectangular element defined by side walls 61 and 62, a bottom wall 63 and a top wall 64. Wall sections 61, 62, 63 and 64 are preferably of a low friction material to permit ease of movement of ram 60 within the horizontal passageway. Ram 60 being reciprocally movable includes a cylinder piston arrangement where a cylinder 66 is provided with a piston rod 67 (see FIGS. 3 and 5) having a platen 68 secured at a forward end of same. Platen 68 provides one of the end walls of the baling chamber. Secured to a face of platen 68 are a plurality of horizontally extending elements 69 that protrude outwardly therefrom in the direction of the baling chamber with each element 69 being spacially separate from adjacent element 69 and cooperating with same to define a slot 69' therebetween for receipt of strapping materials as described hereinafter.

A lower end of the face of platen 68 has a plate 70 hingedly secured to a support element 71 which is in turn secured to platen 68. Plate 70 depends from support element 71 and is held apart from platen 68 by a spacer element 72, with the space between plate 70 and platen 68 defining a bagging material cavity 73. Forward edges 74 of plate 70 protrude beyond the outer edges of horizontally spaced elements 69 for additional bale compression at the bottom end of same, and edges 74 cooperate to define a horizontally extending slot 75 therealong which likewise receives strapping material. Adjacent the top of platen 68, in like fashion to protruding plate 70, a rigidly secured element 76 is provided having forward edges 77 that protrude beyond the outer surfaces of elements 69, for additional bale compression, and cooperate to define a strapping material slot 78 therebetween. An upper curved portion 76' of element 76 is spacially separate from a top wall portion 64 adjacent thereto. Element 75, the face of platen 68, and the underside of top wall 64 define a bagging material cavity 79, the entrance to same being located between curved portion 76' of element 76 and adjacent top wall 64 and being constantly open.

With bagging material cavities 73 and 79, heretofore described being provided for receiving peripheral edges of bagging material along the top and bottom of ram platen 68, bagging materials are receivable within ram 60, behind platen 69. Hinged door sections 61' and 62' are secured to side walls 61 and 62 respectively, and when open permit bagging material to be received therebehind. With ram 60 extended to protrude adequately from within housing 20, door sections 61' and 62' may thus be opened permitting access to the rear side of platen 68 where the peripheral side edges of bagging material placed over platen 68 may be stored and later removed for wrapping of the bale of compressed material.

Figure 2A:
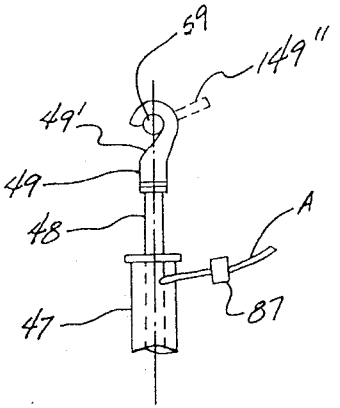
FIG. 2A is a partial plan view of a preferred arrangement of interengageable elements for locking and unlocking of the side doors of the baling chamber.
Figure 2B:
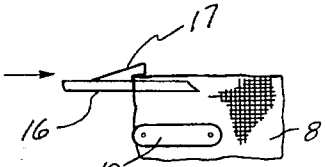
FIG. 2B is a side view of a portion of the bottom wall of the baling chamber.
Figure 2:
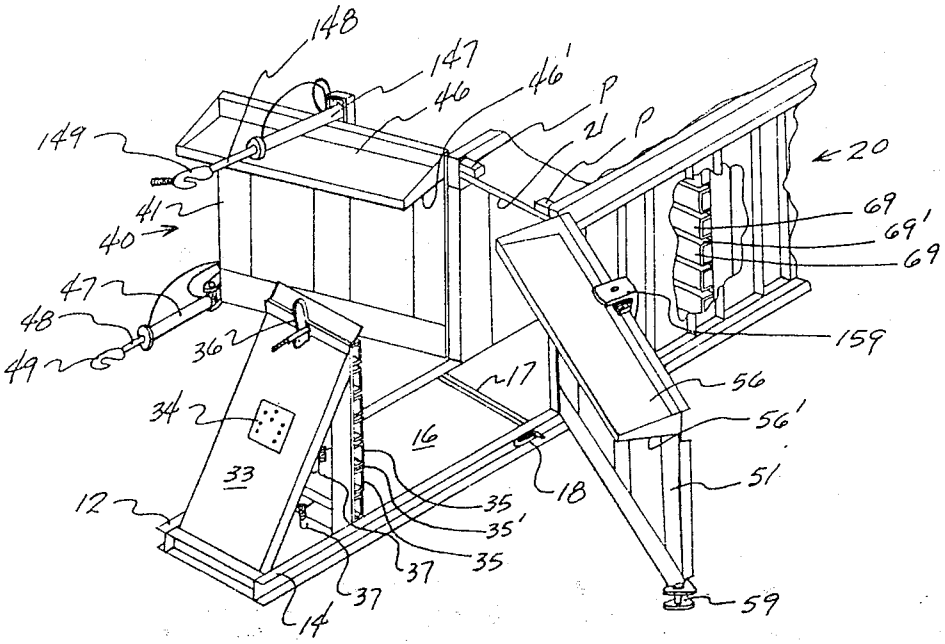
FIG. 2 is a partial perspective view of a horizontal baling and bagging apparatus according to teachings of the present invention illustrating the baling chamber with the side and top walls of same open.
Figure 3:
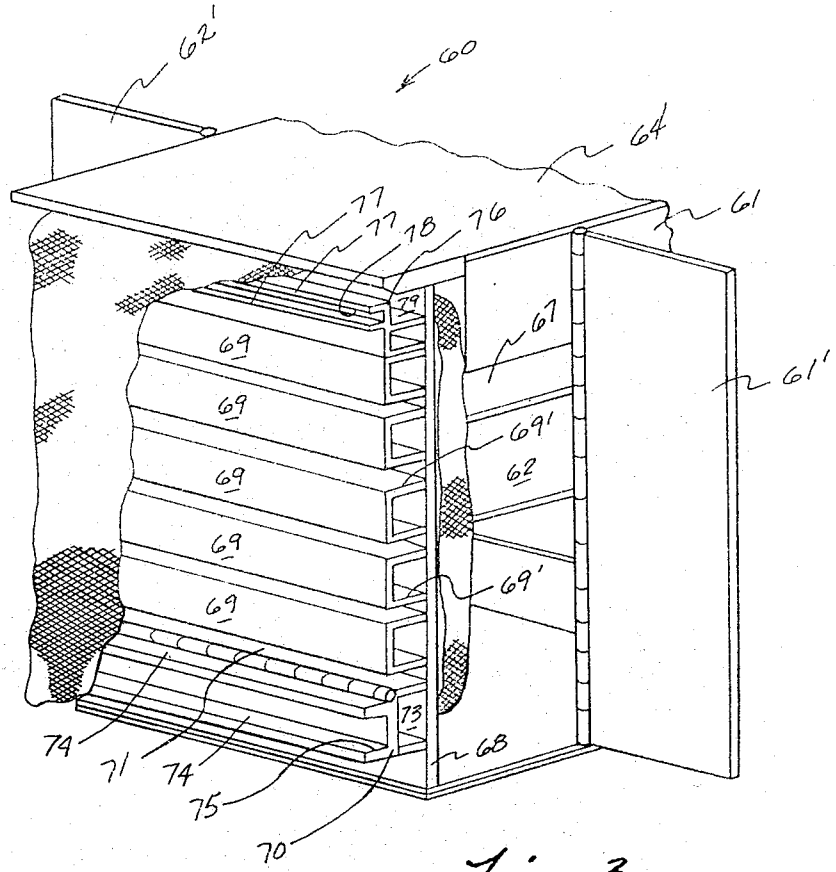
FIG. 3 is a partial perspective view of the baling and bagging apparatus of the present invention illustrating the ram platen in detail.
Figure 4:
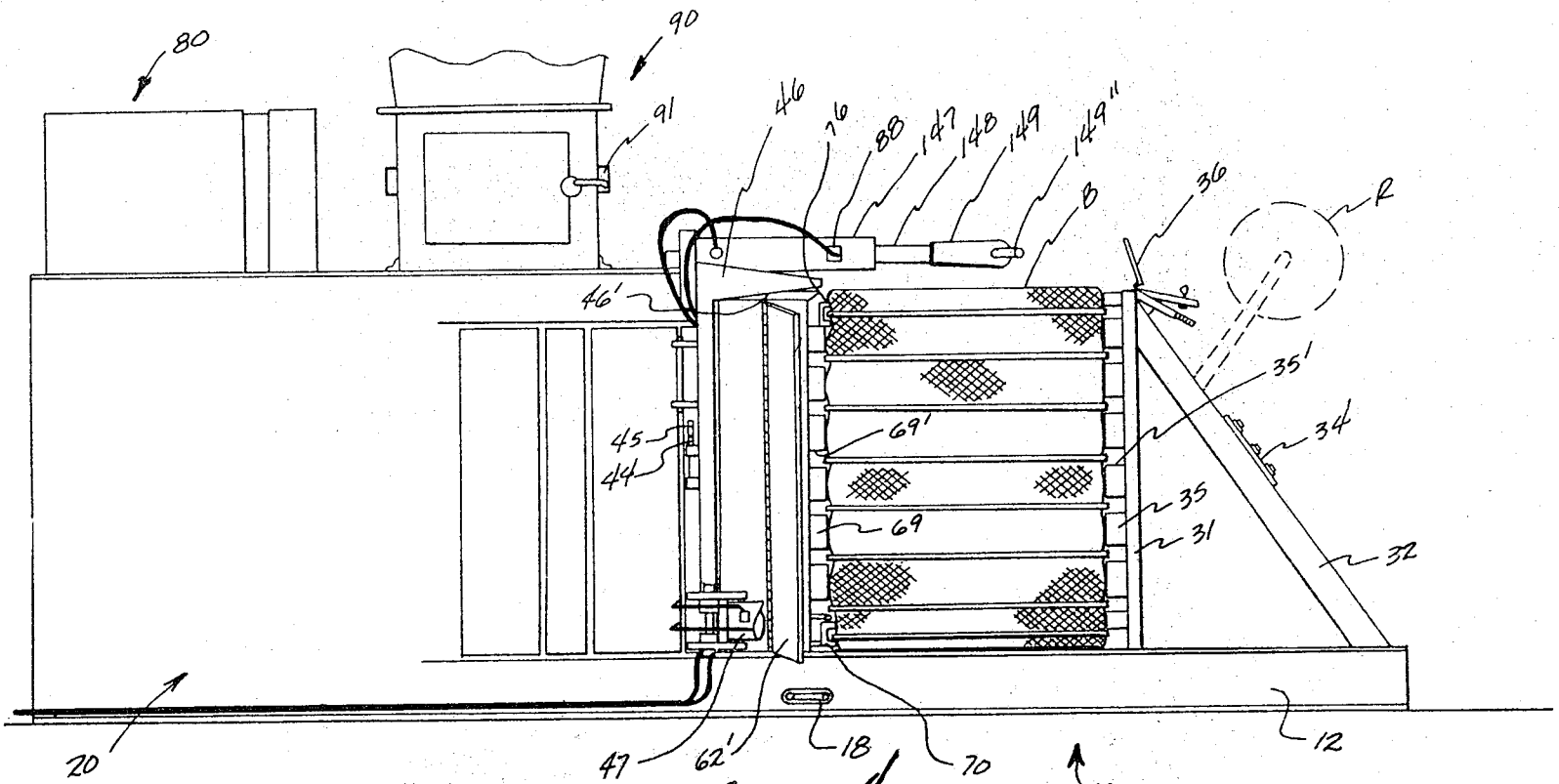
FIG. 4 is a partial side elevational view of the baling and bagging apparatus of the present invention showing the baling chamber open with a bale of fibrous materials therein.

Platen 30, making reference to FIGS. 1, 2, and 4, is defined by a vertically oriented plate 31 which is supported by angularly positioned struts 32 having a planar member 33 secured therebetween on which is located the operator's panel 34 for the apparatus of the present invention. Vertically oriented plate 31 has a plurality of horizontally extending, spacially separate elements 35 which define slots 35' therebetween for receiving strapping material, with slots 35' being positioned directly opposite slots 69'; 75 and 78 on ram platen 68. Located on the rear side of plate 31 are a plurality of pairs of spring loaded hook means 37 (See FIG. 2), with the pairs being spaced vertically apart along the height of plate 31 to permit peripheral edges of bagging material positioned over horizontal elements 35 of platen 30 to be secured thereto such that the portion of the bagging material within the baling chamber is held in a taut condition during bale formation. Platen 30 is likewise provided with a clamp means 36 illustrated as toggle clamp, adjacent the top of same, to receive and hold peripheral edges of bagging material received across elements 35 of platen 30. While a toggle clamp is illustrated, obviously any mechanism suitable for maintaining the particular peripheral edges of bagging material at the particular location would be suitable.

Referring to FIGS. 1, 2 and 2*b*, it may be seen that a lip 17 is provided across bottom wall 16 into which a leading edge of bagging material may be received. Peripheral edges of bagging material adjacent lip 17 may be received within clamp means 18 located at opposite sides of bottom wall 16. Lip 17 is defined on a side of an element 17' opposite ram 60, while an inclined surface 17'' is provided atop element 17' on the ram side of element 17. Clamp 18 is illustrated open in FIG. 2 to receive peripheral edges of bagging material and closed in FIG. 1. With such arrangement a leading edge of bagging material may be secured under lip 17 and held staut there by opposite clamps 18, whereby during compression in the direction of the arrow illustrated in FIG. 2*b*, the bagging material will remain in place to cover the portion of a bale formed immediately thereabove.

With ram platen 68 and stationary platen 30 providing opposite end walls of a baling chamber and bottom wall 16 of frame 10 providing a bottom wall of the baling chamber, attention should now be directed to FIGS. 1, 2 and 4 for a particular description of the side and top wall sections of the baling chamber. As mentioned above, side walls generally indicated as 40 and 50, respectively, are hingedly secured along frame 10, at hinge means 42 and 52 respectively being located between a terminal portion of housing 20 and stationary platen 30, such that, when side walls 40 and 50 are in the closed position, they provide side walls of the baling chamber. Side walls 40 and 50 are fabricated of appropriate structural elements to define horizontal wall sections 41 and 51, respectively. Located on one of the hinge means 42 is an upstanding stud 44 such that when doors 40 and 50 are in the open position, a hook means 45 will engage stud 44 to lock door 40 in the open position, whereby access to the inside of the baling chamber is permitted without interference from the side doors. (See FIG. 1). Though not shown, a like arrangement is provided for door 50. When desirable to close doors 40 and 50, it is simply necessary to lift the hooks from engagement with the studs.

Side doors 40 and 50 are provided at the upper end portions of same with top wall portions 46 and 56 respectively which are secured to horizontal wall sections 41 and 51 and extend outwardly therefrom in the direction of the baling chamber. Upon closure of doors 40 and 50, top wall portions 46 and 56 cooperate to provide a top wall for the baling chamber. The under surfaces 46' and 56' of top wall portions 46 and 56 respectively are tapered toward the outer ends of same to facilitate opening after bale formation.

Side walls 40 and 50 are provided with fluid power motive means for closing and locking, and unlocking same. As illustrated best in FIGS. 1, 2 and 2A, a first cylinder 47 is pivotally secured for horizontal movement to a lower, outer free end of door 41 having a piston rod 48 received therein. An outer free end of piston rod 48 has a hook means 49 secured thereto with hook means 49 having an internal contour 49' defining a camming surface, the purpose of which will be hereinafter described. Opposite side door 50 is provided with a rigidly secured pin 59 that is interengageable with hook means 49 of door 40, such that hook means 49 when placed over pin 59 and piston rod 48 is retracted within cylinder 47, assumes a locking interengagement with pin 59 to securely lock the side walls 40 and 50 in the closed, baling position along the lower ends of same. Located atop the horizontal side wall section 41 is a fluid actuated piston 147, mounted for horizonal movement about its pivot point and having a piston rod 148 reciprocally movable therein. Piston rod 148 has secured thereto at an outer free end of same, a hook means 149 as an interengageable element. An internal surface 149' of hook means 149 defines a camming surface for a purpose to be described. Hook means 149 of upper closure means for side wall 40 furthermore has a handle 149'', the purpose of which will be described hereinafter. Side door 50 has located atop of same, a rigidly secured, vertically oriented pin to receive hook means 149 therearound such that during closure, the internal surface 149' of same automatically centers pin 159 along a line axial to a center line through piston rod 148 in the completely closed position.

Figure 5:
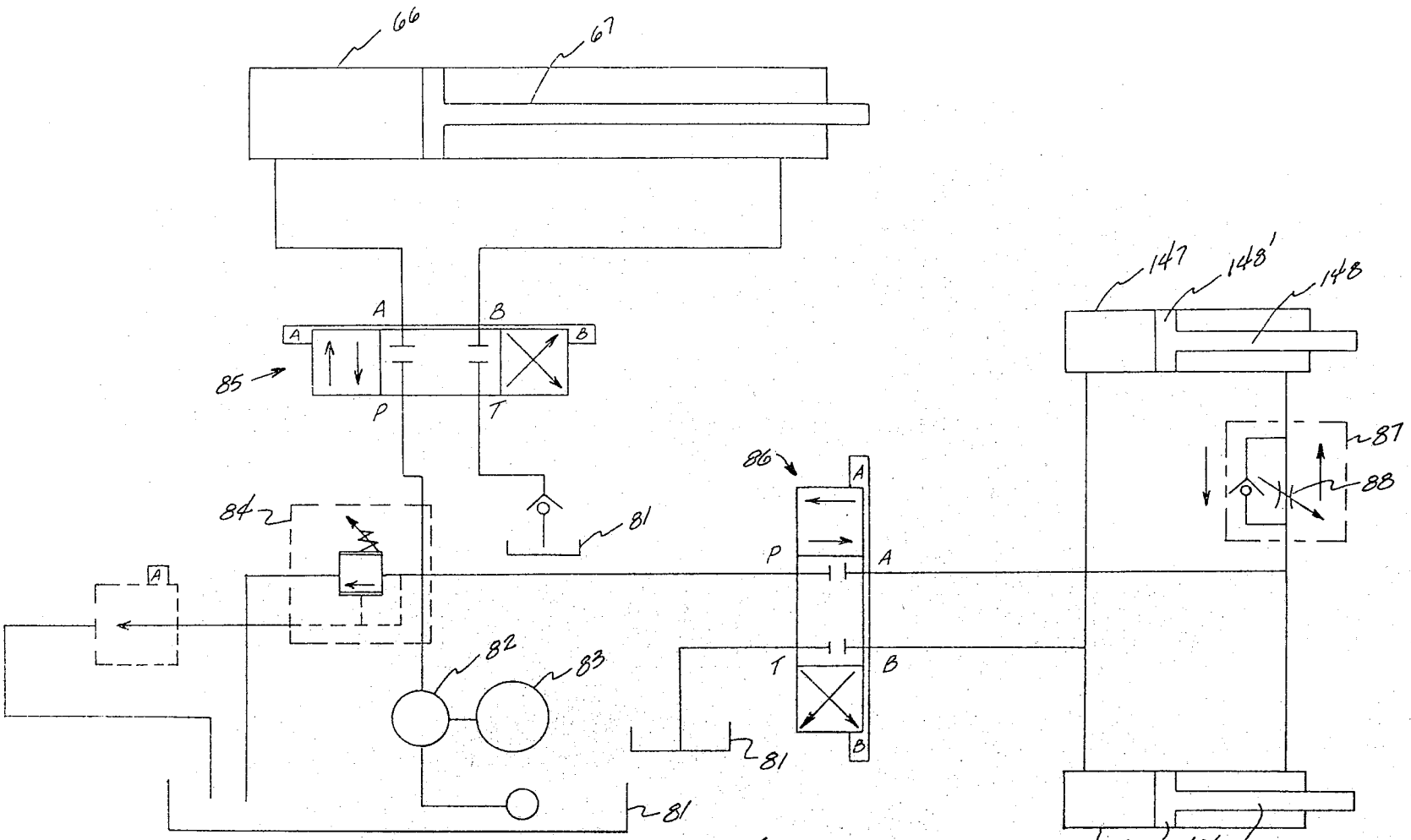
FIG. 5 is a schematic of a preferred hydraulic system for operation of the baling and bagging apparatus of the present invention.

Making reference to FIG. 5, a preferred source of motive power will be described in detail. As mentioned above, a source of fluid power generally indicated as 80 is provided which preferably is a hydraulic system. A supply of appropriate hydraulic fluid is maintained in a tank 81 which is pumped through the system by a pump 82 which is operated by a motor of suitable power 83. From pump 82, hydraulic fluid passes through a relief valve 84 to a blocked center directional control valve generally indicated as 85. Through conventional solenoid operation fluid connection may be made to the rear side of the cylinder 66 behind piston head 67' of piston rod 66 via lines PA to force ram 60 in the compression direction, or to a front side of piston head 67' via lines PB to retract piston 67 to the material feed position. Also in parallel connection to ram 60 are the door closure cylinders 47 and 147 with a similar, blocked center directional control valve generally indicated as 86 positioned between the source of hydraulic fluid supply and the cylinders 47 and 147 themselves. In the locking procedure, hydraulic fluid is supplied via lines PA through control valve 86 to cylinders 47 and 147, in front of piston heads 48' and 148' to retract pistons 48 and 148, respectively, and thus bring the interengageable elements 49 and 149 into locking engagement with their respective interengageable elements 59 and 159. A direct fluid flow connection is provided between line A and the front side of cylinder 47 while a flow control valve means 87 is located in line A upstream of cylinder 147 and includes an adjustable restrictor valve 88 which is preset to a particular pressure such that the piston 48 is totally retracted within cylinder 47 before flow of hydraulic fluid passes to the front side of cylinder 147 to cause retraction of the piston 148 located atop side wall 140. After retraction of piston 48, hydraulic fluid then passes through restrictor valve 88 to the front side of cylinder 147 causing a slow retraction of piston 148. The slow retraction of piston 148 permits an operator to manually grasp the handle means 149'' on hook means 149 and manually engage hook means 149 with pin 159.

Once contact is made between the inner surface 149' of hook means 149 and the pin 159, camming surface 149' guides pin 159 to its appropriate locked position, where pin 159 resides in a position axial to a center line through piston 148.

To permit opening of side doors 40 and 50 of the baling chamber, the solenoids of directional control valve 86 are reversed, such that P to A is closed and B to P is open, whereby hydraulic fluid is pumped to the rear side of cylinders 47 and 147, respectively, to extend pistons 48 and 148 therefrom. Hook means 49 and 149 will thus become disengaged from respective pins 59 and 159 on opposite side doors 50. While not specifically a part of the present invention, one skilled in the art will obviously recognize from the hydraulic schematic other features that though conventional in the art, permit improved operation of the hydraulic system of the present invention.

Referring to the Figures, operation of the baling and bagging apparatus according to the present invention will be described. Prior to initiation of formation of the bale of compressed material in the apparatus of the present invention, and with the side doors 40 and 50 and appropriate top wall sections 46 and 56 open and ram 60 in an extended compression position, bagging materials are properly positioned on the appropriate surfaces for wrapping of the bale after formation of same. Particularly, a forward edge of bagging material is slipped beneath protruding lip 17 of bottom wall 16 (See FIG. 2B) and opposite peripheral edges of same are presented beneath clamp means 18 on opposite sides of the baling chamber where the bottom bagging material is held taut. An opposite end of the bagging material extends beyond platen 30 and is secured to the lower spring retainer means 37 provided on the rear side of vertical element 31 of platen 30. A further sheet of bagging material is provided on the face of platen 68, making engagement with horizontally positioned elements 69, lower protruding element 70, and upper protruding element 76 with the lower peripheral edge of same being secured within bagging material cavity 73 and the upper peripheral edges of same being secured within bagging material cavity 77. Side peripheral edges of the bagging material are secured behind platen 68, within the space behind doors 61' and 62'. A further sheet of bagging material is provided across the face of platen 30, making contact with horizontally disposed elements 35. An upper peripheral portion of the bagging material on platen 30 is secured beneath clamp 36 while side portions of same extend around platen 30 and are secured by spring retainer means 37 located on the rear side of vertical element 31. A lower peripheral edge of the bagging material provided on platen 30 would terminate adjacent bottom wall 16 of frame 10.

With the bagging materials in place as described above, doors 40 and 50 are closed and locked and the apparatus is now in condition for formation of a bale of compressed material. Hydraulic system 80 is actuated to retract piston rods 47 and 147 by proper energization of the solenoid associated with directional control valve 86. Hook means 49 is initially brought into contact with pin 59 and piston rod 48 is fully retracted into cylinder 47 due to restrictor valve 88 of the flow control means 87. After full retraction of piston rod 48, fluid begins to flow through restrictor valve 88 and piston rod 148 begins a slow retraction. The operator, grasping handle 149'', guides hook means 149 into contact with pin 159, after which hook means 149 is cammed into proper locking contact with pin 159. Doors 40 and 50 are then secured in the fully locked position by proximity switches P and automatic press operation may then proceed. Ram 60 is recessed within housing 20 in a feed position, such that platen 68 is upstream of the chute means 90. Compressible materials are deposited into passageway 21 defined by housing 20, and after a predetermined quantity of fibrous material has been received in the passageway, as determined by sensing means 91 of feed means 90, ram 60 is automatically actuated to receive hydraulic fluid behind piston rod 67' to force same in the forward, compression direction. The material within passageway 21 is then forced into the baling chamber. Subsequent to reaching the compression position, assuming that less than a desired amount of material is presented within the baling chamber, ram 60 automatically retracts to the feed position to receive another charge of material from chute feed means 90. Though not a part of the present invention, located within the side walls 61 and 62 of housing 20 are a plurality of dogs (not shown) that, after retraction of platen 68, extend into passageway 21 and engage materials previously compressed to preclude expansion of same to a point where further infeed of material is thwarted. After ram 60 returns to its innermost, feed position, a further charge of compressible materials is deposited in front of same, and thereafter the cycle is repeated to compress the materials into the baling chamber.

Once a predetermined quantity of material has been received in the baling chamber, appropriate sensing means based on weight, density or the like deactuate ram 60, whereby ram 60 remains in the compression position for the subsequent wrapping of bagging material around the formed bale. Upon the occurence of same, the operator manually actuates the fluid power system to assume a side door opening mode, whereupon hydraulic fluid is forced to the rear side of cylinders 47 and 147 to force pistons 48 outwardly therefrom. Interengageable elements 49 and 149 (hook means) associated with pistons 48 and 148 due to the internal surfaces 49' and 149' of same automatically initiate disengagement with mating interengageable elements (pins) 59 and 159 to open side doors 40 and 50. In the reverse of the closing mode, cylinder 147 and its associated piston 148 with hook means 149 totally disengages, due to the internal camming surface 149' of hook means 149 from pin 159, after which, the lower hook means 49 associated with piston 48 and cylinder 47 may be manually disengaged from its respective pin 59 to permit doors 40 and 50 to be moved to an open position. When in the fully opened position, each of the doors 40 and 50 will be locked in the open position by engagement between hooks 45 and 55 with respective studs 44 and 54, such that inadvertent closing of the doors is prohibited. At that point, with the bale fully formed in the baling chamber, the wrapping materials may be applied around the six sides of the bale as illustrated in FIG. 4.

Particularly, once the side and top walls of the baling are opened by retraction of doors 40 and 50, bagging material from end platen 30 may be released from the spring retainer means 37 and clamp 36 and extended around the formed bale B. Clamps 18 may be opened to release the peripheral portions of the bottom bagging layer to extend upwardly along bale B while bagging material may be pulled from the upper bagging material cavity 77 of ram platen 68 and from within the cavities behind doors 61' and 62' to extend along the sides of bale B. With the bagging material generally in place, strapping of any particular fashion may be extended through slots 69', 75, 78, and 35' of opposing end platens to loosely secure the wrapping materials around the bale B, with the exposed outer peripheral edges of the bagging material being tucked behind the strapping materials.

In this fashion, the entire bale may be wrapped while under ram compression with the exception of the corner at the junction of ram platen 68 and bottom wall 16. The particular corner referred to represents only a short distance in the neighborhood of half an inch, such that ram 60 may be retracted slightly to permit opening of the bottom hinged door 70 to permit the retraction of the peripheral edges of bagging material from within bagging material cavity 73. The peripheral edges may then be slipped beneath bale B after which ram 60 is moved forward to compression condition again to release tension on the strapping materials and the bagging material may be slipped therebeneath. Thereafter upon release of the ram pressure, the strapping materials will become tightened due to expansion of the bale material, whereby the wrapping will be securely fastened therearound.

Alternatively, the ram may be totally retracted, the bale removed from the baling chamber, and which the peripheral edges of bagging material from cavity 73 may be stuffed behind the lowermost or next adjacent strap.

In a further embodiment of the present invention as illustrated in phantom in FIG. 4, a roll of bagging material R may be provided on or adjacent a rear side of platen 30. Prior to formation of the bale, a forward edge of the rolled material may be positioned beneath lip 17 of bottom wall 16 of frame 10 and provided in a taut condition by clamps 18, after which the continuous sheet of bagging material would extend along bottom wall 16, up vertical platen 30 and be secured in place, with peripheral edges of same being held by spring biased means 37 and clamp 35. In this embodiment, a separate sheet of bagging material would be placed on platen 68 in like fashion as described above. After formation of the bale, and opening of the side and top walls, a further length of bagging material would be unrolled from the roll R and placed across the top surface of the bale B up to an end of same adjacent platen 68 and the material then severed. Peripheral edges of the continuous length of bagging material from the roll R would then be properly positioned about the sides of bale B and the further sheet of bagging material from ram platen 68 would be positioned about bale B in the manner described above. Suitable strapping materials can then be applied as described. This embodiment would be advantageous for a high production baling rate, or where a high quality waste material is being baled. The continuous bagging material would be applied to five sides of the formed bale with only the side adjacent the ram platen 68 utilizing a separate piece of bagging material. In like fashion as described above, the corner of the bale at the juncture between the ram platen 68 and bottom wall 16 may be closed in either of the procedures described.

In describing the present invention, certain obvious further details of the baling press as set forth in my prior copending application Ser. No. 186,193, filed Sept. 11, 1980, have not been specifically set forth, but are incorporated herein by reference.

Any suitable bagging material may be utilized in conjunction with the present apparatus depending upon the strength or covering characteristics desired for the material being baled, including but not limited to burlap, polymeric films, and the like. In like fashion, any suitable strapping materials may be employed so long as the desired strength characteristics are met, including without limitation, metal straps, wire, polymeric straps and the like.

Having described the present invention in detail, it is obvious that one skilled in the art will be able to make variations and modifications thereto without departing from the scope of the invention. Accordingly, the scope of the present invention should be determined only by the claims appended hereto.

That which is claimed is:

1. Baling and bagging apparatus comprising:

(a) a horizontal bale compression means including a baling chamber and a compression ram mounted for reciprocal movement with respect thereto, said baling chamber being defined by two end walls, a bottom wall, a top wall and two side walls, said top and side walls being moveable between a closed baling position and an open position; one said end wall being spaced apart from said compression ram to receive bagging material in overlying relation to a face of same, peripheral edge portions of said bagging material being secured out of said baling chamber for subsequent wrapping about portions of a bale to be formed, a face of said compression ram defining the other of said end walls and receive bagging material in overlying relationship thereacross, said ram defining peripheral means for receiving peripheral edge portions of bagging material therein and holding same during bale formation, said bottom wall being provided with lip means to receive a leading edge of bagging material and hold same in place during formation of bale thereover, said lip means comprising an element secured to said bottom wall and extending across same, said element having an inclined surface on the ram side of same and defining a lip therebeneath on the opposite side of same to receive said leading edge and clamp means located on opposite sides of said bottom wall to secure other peripheral edge portions of said material outside said baling chamber whereby said material is held taut during bale formation; and (b) means for applying strapping around said bagging after same has been wrapped about said bale and while said bale remains in the baling chamber, whereby a substantially completely wrapped bale of material may be removed from said apparatus.

2. Apparatus as defined in claim 1 wherein said ram face defines a bagging material cavity horizontally across a lower portion of same, said cavity having a closure hinged thereacross for opening after bale formation, and a horizontal bagging material cavity across an upper portion of same, said cavity having a partial permanent closure thereacross providing access to said cavity, and said ram defines vertical bagging cavities along each side of same behind the ram face, said vertical cavities being provided with hinged closure members thereover, whereby after bale formation, and without a reduction in ram compression on said bale, once said bale is exposed by opening said side walls, said bagging material may be removed from the respective side and upper cavities and wrapped around respective portions of said bale.

3. Apparatus as defined in claim 1 wherein said end wall spaced apart from said ram is provided with releaseable clamp means adjacent a top portion of same and a plurality of material holding means on the rear side of same for receiving said peripheral portions of bagging material.

4. Apparatus as defined in claim 3 wherein said clamp means is a toggle clamp extending generally across the width of said wall.

5. Apparatus as defined in claim 4 wherein said holding means behind said end wall comprise a plurality of pairs of spring loaded hooks.

6. Horizontal baling and bagging apparatus comprising:

(a) a frame, said frame having a bottom wall and a stationary vertical platen secured at one end of same, said frame also including a housing located at an end of same opposite said platen, said housing defining a horizontal passageway therealong terminating spacially apart from said platen, said frame further having a pair of side wall sections secured thereto for movement between a closed position adjacent said housing and said platen and an open position;

(b) a ram received in said horizontal passageway for reciprocal movement between a first, feed position and a second, compression position, said ram having a compression platen received at an end of same; said compression platen, vertical platen, side walls and bottom wall defining a closed baling chamber; said compression platen, vertical platen and bottom wall receiving bagging material thereover and having means associated therewith for securing peripheral portions of said material outside said baling chamber to preclude displacement of said material within said baling chamber during bale formation and permitting release of secured bagging portions after bale formation and while said ram is in the compression position to permit said bale to be substantially totally wrapped and the wrapping secured thereto before ram compression pressure is released, said bottom wall having an element secured thereto adjacent said housing and extending substantially across same, said element having an inclined upper surface on the ram side of same and defining a lip therebeneath on an opposite side to receive a leading edge of said bagging material and releaseable clamp means located adjacent opposite sides of same to receive and hold peripheral portions of said bagging material outside said baling chamber whereby said material under said lip means may be held taut during bale formation;

(c) fluid operated means to provide reciprocal movement to said ram; and (d) means for feeding material to be baled and bagged into said passageway when said ram is in the feed position.

7. Apparatus as defined in claim 6 comprising further, a supply of continuous bagging material received behind said vertical platen, whereby said bagging material may be withdrawn from supply to extend along said bottom wall and said vertical platen before bale formation, and after bale formation may be placed over the top of the bale and the peripheral edges of same placed over sides of the bale such that a continuous length of bagging material covers five of the six sides of the wall.

8. Horizontal baling and bagging apparatus comprising:

(a) a frame, said frame having a bottom wall and a stationary vertical platen secured at one end of same, said frame also including a housing located at an end of same opposite said platen, said housing defining a horizontal passageway therealong terminating spacially apart from said platen, said frame further having a pair of side wall sections secured thereto for movement between a closed position adjacent said housing and said platen and an open position;

(b) a ram received in said horizontal passageway for reciprocal movement between a first, feed position and a second, compression position, said ram having a compression platen received at an end of same, said compression platen, vertical platen, said walls and bottom wall defining a closed baling chamber; said compression platen, vertical platen and bottom wall receiving bagging material thereover and having means associated therewith for securing peripheral portions of said material outside said baling chamber to preclude displacement of said material within said baling chamber during bale formation and permitting release of secured bagging portions after bale formation and while said ram is in the compression position to permit said bale to be substantially totally wrapped and the wrapping secured thereto before ram compression pressure is released, said vertical platen and said ram compression platen defining a plurality of spacially separate, horizontal grooves therein, through which strapping materials may be passed, said bottom wall having an element secured thereto adjacent said housing and extending substantially across same, said element having an inclined upper surface on the ram side of same and defining a lip therebeneath on an opposite side to receive a leading edge of said bagging material and releaseable clamp means located adjacent opposite sides of same to receive and hold peripheral portions of said bagging material whereby said material under said lip means may be held taut during bale formation;

(c) fluid operated means to provide reciprocal movement to said ram; and (d) means for feeding material to be baled and bagged into said passageway when said ram is in the feed position.

9. Apparatus as defined in claim 8 wherein said compression platen defines horizontal bagging material cavities across upper and lower portions of same and a portion of said ram behind said compression platen defines vertically oriented bagging material cavities, said lower horizontal and said vertical bagging material cavities having hinged closure members thereover, and said upper horizontal bagging material cavity being partially enclosed by a portion of a face of said compression platen.

10. Apparatus as defined in claim 9 wherein portions of said compression platen in front of said horizontal bagging material cavities protrude beyond the remainder of the face of the compression ram.

11. Apparatus as defined in claim 8 wherein said vertical platen has releaseable clamp means received about a top portion of same for receiving and holding a peripheral edge of bagging material presented thereat, and a plurality of spring loaded hook means at a rear side of same for receiving and holding further peripheral edges of said bagging material overlying said vertical platen.

* * * * *

UNITED STATES PATENT AND TRADEMARK OFFICE

CERTIFICATE OF CORRECTION

PATENT NO. : 4,407,107

DATED : October 4, 1983

INVENTOR(S) : George F. Smith, Jr.

It is certified that error appears in the above-identified patent and that said Letters Patent are hereby corrected as shown below:

Column 1, line 9, "967" should read --997--.

Column 2, line 58, "156" should read --186--.

Column 10, line 39, after "48", insert --and 148--.

Column 14, Claim 8, (b), line 14, "said" should read --side--.

Signed and Sealed this

Twentieth Day of December 1983

[SEAL]

*Attest:*

*Attesting Officer*

GERALD J. MOSSINGHOFF

*Commissioner of Patents and Trademarks*